US005984849A

United States Patent [19]

Ohki et al.

[11] Patent Number: 5,984,849

[45] **Date of Patent: *Nov. 16, 1999**

[54] SEMICONDUCTIVE RUBBER ROLLER

[75] Inventors: Tsuneo Ohki; Shuji Oguchi, both of Saitama-ken, Japan

[73] Assignee: Shin-Etsu Polymer Co., Ltd., Japan

[ * ] Notice: This patent is subject to a terminal disclaimer.

[21] Appl. No.: 09/066,668

[22] Filed: Apr. 28, 1998

[30] Foreign Application Priority Data

May 19, 1997 [JP] Japan ..... 9-128315

[51] Int. Cl.[6] ..... G03G 15/08

[52] U.S. Cl. ..... 492/56; 492/53; 492/59

[58] Field of Search ..... 492/53, 56, 59

[56] References Cited

U.S. PATENT DOCUMENTS

| | | | |
|---|---|---|---|
| 4,101,686 | 7/1978 | Strella et al. | 427/22 |
| 5,366,772 | 11/1994 | Badesha et al. | 428/35.8 |
| 5,720,704 | 2/1998 | Fukunaga | 492/59 |
| 5,827,160 | 10/1998 | Ohki et al. | 492/56 |

FOREIGN PATENT DOCUMENTS 0 609 038 8/1994 European Pat. Off. .

0 797 127 9/1997 European Pat. Off. .

OTHER PUBLICATIONS

Patent Abstracts of Japan, 15(217) (M–1120), Jun. 4, 1991 (abstract of JP 3–061533).

Patent Abstracts of Japan, 17(179) (P–1517), Apr. 7, 1993 (abstract of JP 4–333873).

Patent Abstracts of Japan, 16(286) (P–1376), Jun. 25, 1992 (abstract of JP 4–076577).

Patent Abstracts of Japan, 14(184) (C–0709), Apr. 13, 1990 (abstract of JP 2–029463).

*Primary Examiner*—S. Thomas Hughes
*Assistant Examiner*—Steven A. Blount
*Attorney, Agent, or Firm*—Wenderoth, Lind & Ponack, L.L.P.

[57] ABSTRACT

The invention provides a novel semiconductive silicone rubber roller suitable for use as a development roller in a photocopying machine exhibiting high performance with stability and long durability. The rubber roller is prepared by (A) forming a cylindrical layer of a semi-conductive silicone rubber on and around a metallic core mandrel, (B) irradiating the surface of the rubber layer with ultraviolet light and (C) coating the ultraviolet-irradiated surface of the rubber layer with a silane coupling agent.

10 Claims, No Drawings

SEMICONDUCTIVE RUBBER ROLLER

BACKGROUND OF THE INVENTION

The present invention relates to a semiconductive rubber roller or, more particularly, to a rubber roller of which the cylindrical rubber layer on and around a conductive core mandrel has semiconductivity and suitable for use in a development unit of a photocopying machine as a development roller or as a toner-transfer roller.

It is known that a so-called semiconductive rubber roller consisting of a core mandrel of an electroconductive material such as metals and a semiconductive rubber layer on and around the core mandrel is used in a development unit of a photocopying machine, which is a device to visualize the electrostatic latent images built up in a photosensitive drum as a latent image carrier, by using a triboelectrically charged toner in the form of a thin layer on the outer surface of a toner carrier of which the surface layer is made from a semiconductive rubber. The semiconductive rubber layer in the semiconductive rubber roller is required to have an adequate electroconductivity, high weatherability to withstand adverse ambient conditions, low rubber hardness and good triboelectric chargeability. In this regard, the semiconductive rubber layer is formed usually from a rubber composition composed of a urethane rubber, NBR or silicone rubber as the base component with admixture of an electroconductivity-imparting agent which is an ionically conductive compound or an electroconductive filler.

As a method for controlling the quantity of electrostatic charges borne on the toner carrier, an article entitled "Contact Charging of Aminosilane-treated Silica Particles" by T. Oguchi, et al. appearing in "Shikizai" (Coloring Materials), volume 56 (9), pages 630–636 (1982) teaches that the quantity of contact charges can be controlled by adequately selecting the kind and amount of the polar groups such as amino and hydroxyl groups to be adsorbed on the surface of the toner particles.

As is known, the chargeability of an organic compound is determined by the electron-accepting and electron-donating behavior of the molecules constituting the compound. According to an article entitled "Capturing Surfaces and Interfaces with Static Electricity" by T. Oguchi appearing in "Hyomen" (Surface), volume 33, No. 3 (1995), the electron-accepting group, i.e. acidic group, is exemplified by nitro, halogen and sulfone groups and an organic compound having these groups introduced into the molecular structure exhibits negative chargeability while the electron-donating group, i.e. basic group, is exemplified by amino and ammonium groups and an organic compound having these groups introduced into the molecular structure exhibits positive chargeability. Japanese Patent Kokai 61-173270 discloses a triboelectrically chargeable blade as an application of the above mentioned information.

It is usual that the conventional semiconductive rubbers for semiconductive rubber rollers based on a urethane rubber or NBR are compounded with various kinds of process oils and softening agents with an object of decreasing the rubber hardness. Since these oily additives added in the rubber necessarily cause the phenomenon of bleeding on the surface of the roller, the surface of a semiconductive rubber roller is usually provided with a protective coating layer from a resinous material such as urethane resins and nylon resins. A problem in such a resin-coated semiconductive rubber roller is that the weatherability of the resinous coating layer is not always very high so that, when the semiconductive rubber roller is kept prolongedly in an atmosphere of high temperature and high humidity, the resinous ingredient in the coating layer is subject to a hydrolysis reaction to cause troubles that the rubber roller adheres to the photosensitive drum or the chargeability behavior of the semiconductive rubber roller is greatly affected depending on the changes in the ambient temperature and humidity in an extreme case. Furthermore, the chargeability characteristic of conventional semiconductive rubber rollers relative to toner particles is more or less dependent on the ambient conditions so that the distribution of electrostatic charging is sometimes very broad resulting in defective development with grayish background or so-called fogging due to local deficiency of electrostatic charging.

On the other hand, a semiconductive rubber roller using a semiconductive silicone rubber has excellent stability and little dependency on the ambient conditions in the chargeability characteristic against negatively charged toner particles with very uniform distribution of charging though with a problem that the trouble of fogging in printing is sometimes caused due to insufficient transfer of the static electricity to the toner particles but this measure is not very satisfactory because of the frequent occurrence of fogging in the initial stages under adverse ambient conditions of high temperature and high humidity.

SUMMARY OF THE INVENTION

The present invention accordingly has an object to provide, in view of the above described problems and disadvantages in the prior art, a novel and improved semiconductive rubber roller suitable for use in a development unit of a photocopying machine as a development roller or a toner-transfer roller having excellent durability and weatherability and exhibiting good stability in transfer of electrostatic charges to the toner particles with little occurrence of fogging on the photocopied material as well as a method for the preparation of such a semiconductive silicone rubber roller.

Thus, the semiconductive rubber roller of the present invention is an integral body which comprises:

(a) a core mandrel of an electroconductive material; and (b) a cylindrical rubber layer formed on and around the core mandrel from a cured semiconductive silicone rubber composition, the surface of the rubber layer being irradiated with ultraviolet light to form silicon-bonded hydroxyl groups and coated with a silane coupling agent which is preferably an organosilane compound represented by the general formula $$X_2Si(OR)_2, \quad (I)$$

in which each each X is, independently from the other, a group having an electron-accepting group or an electron-donating group and each R is, independently from the other, a methyl group or ethyl group.

In particular, the electron-accepting group contained in the group denoted by X in the above given general formula (I) is exemplified by nitroso group, carbonyl group and carboxyl group and the electron-donating group is exemplified by amino group, hydroxyl group and ether linkage.

DETAILED DESCRIPTION OF THE PREFERRED EMBODIMENTS

As is described above, the semiconductive rubber roller of the invention is an integral body consisting of an electroconductive core mandrel and a cylindrical rubber layer formed on and around the core mandrel from a semiconductive silicone rubber. The material of the electroconductive core mandrel is not particularly limitative provided that the material is rigid and has good electric conductivity and can be selected, in consideration of the economic merit, workability in machining, mechanical strength and other factors, from metals and alloys such as iron, aluminum, stainless steel and brass and electroconductive resins obtained by compounding a thermosetting resin with a conductivity-imparting agent such as carbon black and metal particles. Alternatively, the electroconductive core mandrel can be prepared by providing a metallic plating layer on the surface of a mandrel formed from an insulating thermosetting resin so as to be rendered electroconductive on the surface.

The semiconductive rubber layer on and around the core mandrel is formed by curing a silicone rubber composition obtained by compounding a polyorganosiloxane gum with a reinforcing silica filler, an electroconductivity-imparting filler and a curing agent. The polyorganosiloxane can be a dimethyl silicone, methyl vinyl silicone or methyl phenyl silicone of a high molecular weight. The reinforcing silica filler can be a fumed silica filler or a precipitated silica filler. The curing agent is an organic peroxide or, when the organopolysiloxane has silicon-bonded vinyl groups in the molecule, a combination of an organohydrogenpolysiloxane and a platinum compound as a catalyst for the hydrosilation reaction. The electroconductivity-imparting agent is selected from carbon blacks and powders of a metal such as nickel, aluminum and copper or, alternatively, particles of a non-conductive material such as metal oxides, e.g., zinc oxide and tin oxide, as well as barium sulfate, titanium dioxide and potassium titanate coated with tin oxide. The amount of the electroconductivity-imparting agent compounded with the organopolysiloxane gum should be sufficient to impart the rubber composition with a volume resistivity in the range from $10^1$ to $10^9$ ohm-cm at room temperature. When the volume resistivity of the rubber composition is outside of this range, troubles are caused, when the roller is used in a photocopying machine, such as occurrence of fogging on the photocopied material, decrease in the efficiency of toner transfer and inadequate printing density.

Preparation of the rubber roller body consisting of a core mandrel and a cylindrical rubber layer is conducted by the method of extrusion using a crosshead on an extruder machine to extrude the uncured silicone rubber composition on and around the electroconductive core mandrel and the thus obtained integral roller body is subjected to primary curing of the silicone rubber composition by heating in a Geer oven or infrared oven, by introducing a flowable rubber composition into a metal mold with the core mandrel set therein and effecting primary curing of the rubber composition in the metal mold at room temperature or by heating or by compression-molding the rubber composition in a metal mold under heating integrally with the core mandrel followed by a heat treatment of the rubber composition after the primary curing in a suitable oven to effect secondary curing thereof to obtain stabilized properties of the rubber roller.

The next step in the preparation of the inventive rubber roller is irradiation of the surface of the cured rubber layer with ultraviolet light although it is optional that the ultraviolet irradiation is preceded by a mechanical finishing work of the rubber surface on a machine tool such as cylindrical grinding machines, shot blasting machines, sand blasting machines, lapping machines and buffing machines to obtain a desirable surface condition. The ultraviolet irradiation of the rubber surface is conducted in an oxidizing atmosphere such as atmospheric air so that the rubber surface is imparted with a further increased hardness and hydroxyl groups are formed on the rubber surface. Formation of the hydroxyl groups on the rubber surface can be detected by the infrared analysis and ESCA analysis. The irradiation dose of the rubber surface with ultraviolet light should be in the range from 1 to 100 J/cm$^2$. When adequately irradiated with ultraviolet light, the surface of the silicone rubber layer is imparted with improved abrasion resistance to cause little changes in the surface ruggedness with very good stability in the toner transfer characteristic even after prolonged running of the photocopying machine.

The final step for finishing the inventive silicone rubber roller is coating of the ultraviolet-irradiated rubber surface with a silane coupling agent. The method of the coating work is not particularly limitative including spray coating, brush coating, dipping and roller coating. If necessary, drying of the silane coupling agent can be accelerated by heating at an elevated temperature.

The silane coupling agent here used is preferably a silane compound represented by the general formula (I) given above, in which each X is an organic group having an electron-accepting group such as nitroso group, carbonyl group and carboxyl group or an electron-donating group such as amino group, hydroxyl group and ether linkage and each R is a methyl group or ethyl group. The types of the silane coupling agent should be selected according to the charging polarity of the toner particles used in the photocopying development unit. Namely, the silane coupling agent having the electron-donating groups is suitable for use with a negatively charging toner and silane coupling agent having the electron-accepting groups is suitable for use with a positively charging toner. When the coating treatment with a silane coupling agent is performed adequately, good matching is obtained in the charging characteristics between the rubber surface of the roller and the toner particles so that the disadvantageous phenomenon of fogging on the photocopied material can be further decreased. The coating amount of the silane coupling agent on the surface of the semiconductive silicone rubber layer is in the range from 0.5 to 10 g/m$^2$. In respect of the fogging-decreasing effect, the above described difunctional silane coupling agent is particularly effective as compared with monofunctional silane coupling agent and the effectiveness can be more remarkably exhibited under adverse ambient conditions of high temperature and high humidity. In other words, compatibility of the surface of the semiconductive rubber roller with the toner particles in respect of the charging characteristics can be controlled by the selection of the silane coupling agent. Namely, the toner particles can be electrostatically charged to an appropriate potential level with a narrow distribution of the charging amount so that a photocopied material of high quality can be obtained with stability of the printing density in the photocopied patterns and without the disadvantage of fogging.

Though not clearly understood, following is a presumable mechanism for the above mentioned improvement obtained by the coating treatment with a silane coupling agent. Namely, while silanolic hydroxyl groups are formed on the rubber surface by the preceding ultraviolet irradiation treatment, the alkoxy groups, i.e. methoxy or ethoxy groups, in the silane coupling agent pertain to the dealcoholation condensation reaction with the silanolic hydroxyl groups on the rubber surface to form siloxane linkages so that the electron-accepting or electron-donating groups in the molecules of the silane coupling agent are outwardly directed to improve the efficiency in the transfer of the static electricity between the roller surface and the toner particles. Incidentally, the phenomenon of fogging is caused presumably in the deficiency of the charging amount of the static electricity so that a decrease in fogging could be expected when improvements are accomplished in the contacting efficiency between the roller surface and the toner particles and in the efficiency of transfer of electrostatic charges therebetween.

The electroconductive core mandrel, which supports the semiconductive silicone rubber layer on and around the core mandrel, is usually grounded directly or with application of a bias voltage to exhibit stable performance for the development of the electrostatic latent images by means of charging on the electrostatic latent image carrier, transfer of the electrostatic charges to the toner particles and transportation of the toner particles to the electrostatic latent image carrier.

The semiconductive silicone rubber layer of the rubber roller serves as an electrode in the steps of electrostatic charging and development as well as for contact charging of the toner particles by the transfer of charges and also serves in the steps of toner transportation and development for carrying and transporting the toner particles on the surface thereof by means of the ruggedness of the surface and the van der Waals force, image force and coulomb force. Electrostatic charging of the toner particles is conducted by means of the frictional contacting between a triboelectric charging blade, toner transportation roller or electrostatic latent image carrier and the surface of the development roller having a semiconductive rubber layer.

In the following, the semiconductive rubber roller of the present invention is described in more detail by way of Examples, which, however, never limit the scope of the invention in any way. In the following Examples and Comparative Examples, the semiconductive silicone rubber layer was evaluated for the following items by the testing procedures respectively described there.

(1) Roller Resistance

The rubber roller after ultraviolet irradiation and before and after coating with a silane coupling agent was mounted in a horizontal disposition on the surface of a gold-plated electrode having a length 5 mm longer than the rubber layer of the roller and the electric resistance was measured between the gold-plated electrode and the core mandrel of the roller which was downwardly pressed against the electrode by hanging a 500 g weight on each end of the mandrel with application of a DC voltage of 10 volts.

(2) Surface Roughness

Measurement of surface roughness was undertaken for the rubber layer after ultraviolet irradiation and before and after coating with a silane coupling agent by using a universal roughness tester for the 10-points average surface roughness around the rubber layer.

(3) Fogging

The rubber roller was mounted as a development roller on a photocopying printer and solid black printing, halftone dot printing, 5%-duty printing and solid white printing were repeated to determine the Macbeth density of the white background in the 5%-duty printed images by using a Macbeth densitometer. Measurements were undertaken at the conditions of high temperature and high humidity (conditions I), constant temperature and constant humidity (conditions (II) and low temperature and low humidity (conditions III) for the rubber rollers as prepared (initial) and after use for 6000 times repeated printing runs (after use) in a durability test.

(4) Printing Density

The printing density was measured with a Macbeth densitometer for the solid black printing with the rubber roller as prepared (initial) and after the durability test as in the measurement of fogging (after use).

(5) Overall Rating

The rubber rollers were rated in three overall ratings of A, B and C, the rating of C being given when fogging, either "initial" or "after use", was 0.015 or higher and the printing density, either "initial" or "after use", was lower than 1.30.

EXAMPLE 1

An electroconductive core mandrel was prepared by coating a rod of SUM 22 steel having a diameter of 10 mm and a length of 250 mm with a silicone primer (Primer No. 10, a product by Shin-Etsu Chemical Co.) followed by a baking treatment in a Geer oven at 150° C. for 10 minutes.

Separately, a semiconductive silicone rubber composition was prepared by compounding 100 parts by weight of a peroxide-curable organopolysiloxane gum (KE 78VBS, a product by Shin-Etsu Chemical Co.) with 10 parts by weight of a carbon black (Asahi Thermal, a product by Asahi Carbon Co.) and 25 parts by weight of a fumed silica filler (Aerosil 200, a product by Nippon Aerosil Co.) and kneading the blend in a pressurizable kneader.

The thus obtained semiconductive silicone rubber composition was further blended with 2.0 parts by weight of an organic peroxide- based curing agent (C-8, a product by Shin-Etsu Chemical Co.) to give a curable silicone rubber composition which was introduced into the cavity of a metal mold for compression molding together with the electroconductive core mandrel to be compression-molded at 175° C. for 10 minutes to effect curing of the rubber layer and adhesion thereof to the surface of the core mandrel.

Thereafter, the thus integrated roller body was subjected to secondary curing of the silicone rubber layer in a Geer oven at 200° C. for 7 hours followed by grinding of the surface of the rubber layer on a cylindrical grinding machine to finish the rubber roller having a diameter of 18 mm, length of the rubber layer of 210 mm and roughness Rz of the rubber surface of 8.5 $\mu$m. Further, the surface of the rubber layer was irradiated with ultraviolet light emitted from a low-pressure mercury lamp in air for 30 minutes to give an irradiation dose of 37.8 J/cm$^2$. Formation of hydroxyl groups on the rubber surface could be detected by the infrared spectrophotometry. Before coating with a silane coupling agent mentioned below, the surface roughness Rz of the thus ultraviolet-irradiated rubber layer was 8.5 $\mu$m.

In the next place, the ultraviolet-irradiated rubber surface was coated with a solution prepared by dissolving 10 parts by weight of 3-aminopropyl methyl diethoxy silane (KBE-902, a product by Shin-Etsu Chemical Co.) as a difunctional silane coupling agent in 100 parts by weight of toluene by the method of pad coating in a coating amount of 1.5 g/m$^2$ calculated as the silane compound followed by drying in a Geer oven at 150° C. for 1 hour to finish a semiconductive silicone rubber roller having a surface roughness Rz of 10.5 $\mu$m and a roller resistance of 1.2 Mohm which was mounted on a development unit of a photocopying machine to visualize the electrostatic latent images to be subjected to the evaluation tests in the testing procedures described above. The results obtained in the tests of fogging and printing density are shown in Table 1 below. Blur of printing and adhesion of the toner particles to the roller surface were not found after the durability test.

EXAMPLE 2

The procedures for the preparation of the semiconductive silicone rubber roller and the evaluation tests thereof were substantially the same as in Example 1 except that the coating amount of the silane coupling agent on the ultraviolet-irradiated rubber surface was 1.8 g/m$^2$ and the roller resistance was 5.1 Mohm. The results of the evaluation tests were as shown in Table 1. No particular problems were noted in respect of printing blur and adhesion of toner particles to the roller surface.

EXAMPLE 3

The procedures for the preparation of the semiconductive silicone rubber roller and the evaluation tests thereof were substantially the same as in Example 1 except that the coating amount of the silane coupling agent on the ultraviolet-irradiated rubber surface was 2.2 g/m$^2$ and the roller resistance was 12 Mohm. The results of the evaluation tests were as shown in Table 1. No particular problems were noted in respect of printing blur and adhesion of toner particles to the roller surface.

EXAMPLE 4

The procedures for the preparation of the semiconductive silicone rubber roller and the evaluation tests thereof were substantially the same as in Example 1 except that the coating amount of the silane coupling agent on the ultraviolet-irradiated rubber surface was 3.6 g/m$^2$ and the roller resistance was 35 Mohm. The results of the evaluation tests were as shown in Table 1. No particular problems were noted in respect of printing blur and adhesion of toner particles to the roller surface.

EXAMPLE 5

The procedures for the preparation of the semiconductive silicone rubber roller and the evaluation tests thereof were substantially the same as in Example 1 except that the coating amount of the silane coupling agent on the ultraviolet-irradiated rubber surface was 5.2 g/m$^2$ and the roller resistance was 180 Mohm. The results of the evaluation tests were as shown in Table 1. No particular problems were noted in respect of printing blur and adhesion of toner particles to the roller surface.

COMPARATIVE EXAMPLE 1

The procedures for the preparation of the semiconductive silicone rubber roller and the evaluation tests thereof were substantially the same as in Example 1 except that the coating treatment with the silane coupling agent on the ultraviolet-irradiated rubber surface was omitted, the surface roughness Rz of the rubber layer after the ultraviolet irradiation was 15.2 $\mu$m and the roller resistance was 1.1 Mohm. The results of the evaluation tests were as shown in Table 1. No particular problems were noted in respect of printing blur and adhesion of toner particles to the roller surface.

COMPARATIVE EXAMPLE 2

The procedures for the preparation of the semiconductive silicone rubber roller and the evaluation tests thereof were substantially the same as in Example 1 except that the silane coupling agent was replaced with a trifunctional silane compound N-2-(aminoethyl)-3-amino-propyl trimethoxy silane (KBM-603, a product by Shin-Etsu Chemical Co.) in a coating amount of 2.2 g/m$^2$, the surface roughness Rz of the rubber layer was 10.7 $\mu$m and the roller resistance was 13 Mohm. The results of the evaluation tests were as shown in Table 1. No particular problems were noted in respect of printing blur and adhesion of toner particles to the roller surface.

COMPARATIVE EXAMPLE 3

The procedures for the preparation of the semiconductive silicone rubber roller and the evaluation tests thereof were substantially the same as in Example 1 except that the silane coupling agent was replaced with another trifunctional silane compound octyl triethoxy silane (LS-5580, a product by Shin-Etsu Chemical Co.) in a coating amount of 2.2 g/m$^2$, the surface roughness Rz of the rubber layer was 10.4 $\mu$m and the roller resistance was 13 Mohm. The results of the evaluation tests were as shown in Table 1. No particular problems were noted in respect of printing blur and adhesion of toner particles to the roller surface.

TABLE 1

| | Example | | | | | Comparative Example | | |
|---|---|---|---|---|---|---|---|---|
| | 1 | 2 | 3 | 4 | 5 | 1 | 2 | 3 |
| Fogging initial | | | | | | | | |
| I | 0.014 | 0.013 | 0.012 | 0.012 | 0.012 | 0.017 | 0.015 | 0.015 |
| II | 0.011 | 0.010 | 0.010 | 0.010 | 0.010 | 0.012 | 0.011 | 0.011 |
| III | 0.010 | 0.009 | 0.010 | 0.010 | 0.010 | 0.011 | 0.010 | 0.010 |
| after use | | | | | | | | |
| I | 0.012 | 0.012 | 0.012 | 0.012 | 0.012 | 0.014 | 0.014 | 0.014 |
| II | 0.011 | 0.010 | 0.010 | 0.010 | 0.012 | 0.011 | 0.011 | 0.011 |
| III | 0.010 | 0.010 | 0.010 | 0.010 | 0.010 | 0.010 | 0.010 | 0.010 |
| Printing density | | | | | | | | |
| initial | 1.43 | 1.44 | 1.44 | 1.42 | 1.41 | 1.42 | 1.40 | 1.38 |
| after use | 1.32 | 1.31 | 0.31 | 1.29 | 1.27 | 1.01 | 1.27 | 1.28 |
| Overall rating | B | A | A | A | B | C | C | C |

What is claimed is:

1. A semiconductive rubber roller as an integral body which comprises:

(a) a core mandrel of an electroconductive material; and (b) a cylindrical rubber layer formed on and around the core mandrel from a cured semiconductive silicone rubber composition, the surface of the rubber layer being irradiated with ultraviolet light to form silicon-bonded hydroxyl groups and coated with a silane coupling agent.

2. The semiconductive rubber roller as claimed in claim 1 in which the silane coupling agent is an organosilane compound having, in a molecule, two alkoxy groups and at least one group having an electron-accepting group or an electron-donating group.

3. The semiconductive rubber roller as claimed in claim 2 in which the silane coupling agent is an organosilane compound represented by the general formula $$X_2Si(OR)_2,$$

in which each X is, independently from the other, a group having an electron-accepting group or a group having an electron-donating group and each R is, independently from the other, a methyl group or ethyl group.

4. The semiconductive rubber roller as claimed in claim 2 in which the electron accepting group is selected from the group consisting of a nitroso group, carbonyl group and carboxyl group.

5. The semiconductive rubber roller as claimed in claim 2 in which the electron-donating group is selected from the group consisting of an amino group, hydroxyl group and ether linkage.

6. The semiconductive rubber roller as claimed in claim 1 in which the semiconductive silicone rubber has a volume resistivity in the range from $10^1$ to $10^9$ ohm-cm.

7. The semiconductive rubber roller as claimed in claim 1 in which the coating amount with the silane coupling agent is in the range from 0.5 to 10 g/m$^2$.

8. A method for the preparation of a semiconductive rubber roller which comprises the steps of:

(A) forming a cylindrical layer of a semiconductive silicone rubber on and around an electroconductive core mandrel;

(B) irradiating the surface of the cylindrical layer of the semiconductive silicone rubber with ultraviolet light; and (C) coating the ultraviolet-irradiated surface of the cylindrical layer of the semiconductive silicone rubber with a silane coupling agent.

9. The method for the preparation of a semiconductive rubber roller as claimed in claim 8 in which the irradiation dose in the irradiation of the surface of the cylindrical silicone rubber is in the range from 1 to 100 J/cm$^2$.

10. The method for the preparation of a semiconductive rubber roller as claimed in claim 8 in which the coating amount with the silane coupling agent is in the range from 0.5 to 10 g/m$^2$.

* * * * *